US011116282B2

(12) United States Patent
Rosenberg

(10) Patent No.: US 11,116,282 B2
(45) Date of Patent: Sep. 14, 2021

(54) WATERPROOF BREATHABLE FOOTWEAR

(71) Applicant: W. L. Gore & Associates, Inc., Newark, DE (US)

(72) Inventor: Steve Rosenberg, Newark, DE (US)

(73) Assignee: W. L. Gore & Associates, Inc., Newark, DE (US)

( * ) Notice: Subject to any disclaimer, the term of this patent is extended or adjusted under 35 U.S.C. 154(b) by 0 days.

(21) Appl. No.: 16/620,969

(22) PCT Filed: Jun. 14, 2017

(86) PCT No.: PCT/US2017/037407
§ 371 (c)(1),
(2) Date: Dec. 10, 2019

(87) PCT Pub. No.: WO2018/231214
PCT Pub. Date: Dec. 20, 2018

(65) Prior Publication Data

US 2020/0187588 A1 Jun. 18, 2020

(51) Int. Cl.
*A43B 7/08* (2006.01)
*A43B 7/12* (2006.01)
(Continued)

(52) U.S. Cl.
CPC ..... *A43B 7/125* (2013.01); *A43B 1/10* (2013.01); *A43B 1/14* (2013.01); *A43B 7/085* (2013.01);
(Continued)

(58) Field of Classification Search
CPC .. A43B 7/06; A43B 7/08; A43B 7/085; A43B 7/12; A43B 7/125; A43B 23/06
(Continued)

(56) References Cited

U.S. PATENT DOCUMENTS 1,394,348 A * 10/1921 Pietrowski ..... A43B 7/06 36/3 A
5,357,689 A * 10/1994 Awai ..... A43B 7/06 36/3 A
(Continued)

FOREIGN PATENT DOCUMENTS

CN 101563215 A 10/2009
CN 102256505 A 11/2011
(Continued)

OTHER PUBLICATIONS

International Search Report and Written Opinion for International Application No. PCT/US2017/037407 dated Nov. 6, 2017.

*Primary Examiner* — Marie D Bays
(74) *Attorney, Agent, or Firm* — Greenberg Traurig, LLP

(57) ABSTRACT

The invention is an article of footwear comprising a waterproof upper (30) material having a breathability of less than 3 mg/cm<2>/h according to ISO (11092, 14268) 14268 (2012). The upper (30) material comprising at least one vent having a vent assembly (31) disposed within the at least one vent. The vent assembly (31) further comprises a waterproof, water vapor permeable functional layer (38) and a plurality of slats (32) disposed adjacent to the functional layer (38) and spaced apart from each other and from the functional layer (38) to provide for water-vapor flow through the vent assembly (31).

16 Claims, 10 Drawing Sheets

(51) Int. Cl.
*A43B 1/10* (2006.01)
*A43B 1/14* (2006.01)
*A43B 23/02* (2006.01)

(52) U.S. Cl.
CPC ..... *A43B 23/021* (2013.01); *A43B 23/022* (2013.01); *A43B 23/0235* (2013.01)

(58) Field of Classification Search
USPC ..... 36/3 R, 3 A
See application file for complete search history.

(56) References Cited

U.S. PATENT DOCUMENTS 5,950,333 A * 9/1999 Tsen ..... A43B 5/18 36/127
6,665,954 B2 * 12/2003 Chen ..... A43B 3/02 36/3 A
9,119,441 B2 * 9/2015 Frappier ..... A43B 5/1675
10,104,932 B2 * 10/2018 Kim ..... A43B 13/127
2001/0000272 A1 * 4/2001 Attilieni ..... A43B 23/0255 36/3 A
2004/0049942 A1 3/2004 Chen
2004/0074107 A1 * 4/2004 Tuan ..... A43B 7/10 36/3 R
2004/0111918 A1 * 6/2004 Van Noy ..... A43B 7/087 36/3 A
2009/0203275 A1 8/2009 Dehn
2011/0162239 A1 * 7/2011 Bier ..... A43B 7/08 36/3 B
2014/0208618 A1 * 7/2014 Reuben ..... A43B 23/022 36/102
2015/0335097 A1 11/2015 Bisson
2016/0081422 A1 * 3/2016 Garneau ..... A43B 1/0081 36/7.2
2018/0213884 A1 * 8/2018 Kim ..... A43B 7/08
2020/0187588 A1 * 6/2020 Rosenberg ..... A43B 23/0235

FOREIGN PATENT DOCUMENTS

DE 41 28 704 A1 3/1993
EP 1424018 A1 6/2004
EP 2 286 685 A1 2/2011
EP 2 375 927 A1 10/2011
JP H523902 U 3/1993
JP 2001524854 A 12/2001
JP 2004172457 A 6/2004
JP 3112387 U 8/2005
JP 2006304951 A 11/2006
JP 2009125538 A 6/2009
WO 98/51177 A2 11/1998
WO 2010/072547 A1 7/2010
WO 2017/089081 A1 6/2017

* cited by examiner

WATERPROOF BREATHABLE FOOTWEAR

RELATED APPLICATIONS

The present application is a national phase filing under 35 USC 371 of International Application No. PCT/US2017/037407, filed on Jun. 14, 2017, the entire contents and disclosures of which are hereby incorporated by reference.

FIELD OF THE INVENTION

The present invention relates generally to introducing a breathability function into footwear articles comprising an upper made of a non-breathable, waterproof material. In particular, the present invention relates to a vent in the upper, wherein a vent assembly is disposed within the vent and the vent assembly comprises waterproof, water-vapor permeable functional layer and a plurality of slats disposed adjacent to the functional layer and spaced apart from each other and from the functional layer to provide water-vapor flow through the vent assembly.

BACKGROUND OF THE INVENTION

Waterproof footwear articles comprising a non-breathable upper material are used for a large variety of purposes, including work and sport. Such footwear articles provide protection from the elements, such as water, mud and snow, while also providing durability. One problem with such footwear articles is that if the upper material is waterproof, it loses its ability to breathe, i.e., to permit water-vapor to escape the footwear article. Such low breathability is problematic in a work and sporting footwear article because moisture becomes trapped in the footwear article, causing discomfort to the wearer.

One approach to solving this non-breathability problem has been to include ventilation in the sole of the footwear article. WO 01/10257 teaches ventilated footwear, comprising a lower part incorporated a sole and an upper part coupled to the lower part, shaped to receive the foot of a wearer. The upper part has an arch portion and is provided with an inside surface adapted to permit circulation therethrough, and an outside surface provided with ventilation holes located in the arch portion of the upper part of the footwear. A breathable waterproof, water resistant, or water repellant barrier is sandwiched between the inside and outside surfaces in the arch portion of the upper part of the footwear across the holes. Furthermore, an insole is preferably disposed into the footwear. The insole has an arch portion adjacently located to the arch portion of the upper part of the footwear. The upper layer of the insole is adapted to permit air circulation therethrough. The insole has a bottom layer provided with transverse intersecting channels extending inwardly from a peripheral edge of the insole. At least one of the channels is adjacent to the holes located in the arch portion of the outside surface of the upper part of the footwear. The channels are provided with openings in communication with the upper layer.

Additionally, WO 05/065479 discloses a shoe with an actively breathing sole consisting at least of one perforated outsole which is connected to the shank of a shoe in a direct or indirect manner. Said shoe includes an actively breathing, non water-permeable film-type membrane. In order to ensure that normal everyday shoes can breathe actively in an effective and economical manner without having a negative effect on the characteristics of the soles thereof, window-type openings are provided in the outsole and the soles are sealed with an actively breathing unit which consists at least of one membrane.

While these patents generally teach methods of providing breathability into an otherwise low breathability footwear article, they do not introduce a durable, passive breathable feature into the upper of the footwear article. Thus, there is a need for footwear which provides breathability while retaining waterproofness and durability of the upper.

SUMMARY OF THE INVENTION

In some aspects, the present invention is directed to a waterproof and breathable footwear article comprising: an upper made of a waterproof material having a water vapor permeability of less than 3 mg/cm$^2$/h according to ISO 14268 (2012) and comprising at least one vent; and a vent assembly disposed within the at least one vent, wherein the vent assembly further comprises: a waterproof, water vapor permeable functional layer and a plurality of slats disposed adjacent to the functional layer and spaced apart from each other and from the functional layer. The footwear article may have a moisture vapor permeability of at least 0.4 g/hr according to ASTM D8041 (2016). The material of the upper and the material of the slats may each independently comprise polyvinyl chloride, copolyesters, woven aramids, polyurethane, thermoplastic polyurethane, polyurethane coated textiles, polyurethane coated foam, foamed ethylene-vinyl acetate, patent leather, treated leather (including coated leather), synthetic rubber and/or natural rubber. In some aspects, the material of the upper is synthetic rubber, natural rubber, or combinations thereof. The functional layer may comprise at least one of expanded polytetrafluoroethylene, polyester, copolyether ester, polyether, polyamide, copolyether amides, and polyacrylate. At least one side of the functional layer may be laminated to a textile, an open cell foam, or a reticulated foam. The textile may be a knit, a woven, a non-woven, or a felt. The article may further comprise an internal insulating layer adjacent to the upper. In some aspects, the slats are parallel to each other. The slats may be attached to a frame. In some aspects, the slats are off-set. The vent assembly may further comprise an overmold. The vent assembly may be attached to the upper by molding, vulcanization, application of a thermoplastic gasket or tape, an adhesive or is sewn onto the upper. The vent may comprise at least two rows of slats. The slats may be nested. The slats may be spaced less than or equal to 1 mm apart in a lateral direction. The slats may be spaced at least 1 mm apart from the functional layer. The slats may be adjustable within the frame. A rinse port may exist between the slats and the functional layer to allow for the washing out or removal of accumulated debris. The vent assembly may occupy from 0.1 to 50% of total surface area of the upper.

In further aspects, the present invention is directed to a footwear article comprising: an upper made of a waterproof material having a water vapor permeability of less than 3 mg/cm$^2$/h according to ISO 14268 (2012) and comprising at least one vent; and a vent assembly disposed within the at least one vent, wherein the vent assembly further comprises: a waterproof, water vapor permeable functional layer, a plurality of slats disposed adjacent to the functional layer and spaced apart from each other and from the functional layer, and a rinse port for washing out debris. The footwear article may have a moisture vapor permeability of at least 0.4 g/hr according to ASTM D8041 (2016). The material of the upper and the material of the slats may each independently comprise polyvinyl chloride, copolyesters, woven aramids, polyurethane, thermoplastic polyurethane, polyurethane coated textiles, polyurethane coated foam, foamed ethylene-vinyl acetate, patent leather, treated leather, synthetic rubber and/or natural rubber. In some aspects, the material of the upper is synthetic rubber, natural rubber, or combinations thereof. The functional layer may comprise at least one of expanded polytetrafluoroethylene, polyester, copolyether ester, polyether, polyimide, copolyether amides, and polyacrylate. At least one side of the functional layer may be laminated to a textile, an open cell foam, or a reticulated foam. The textile may be a knit, a woven, a non-woven, or a felt. The article may further comprise an internal insulating layer adjacent to the upper. In some aspects, the slats are parallel to each other. The slats may be attached to a frame. In some aspects, the slats are off-set. The vent assembly may further comprise an overmold. The vent assembly may be attached to the upper by molding, vulcanization, application of a thermoplastic gasket or tape, an adhesive or is sewn onto the upper. The slats may be nested. The slats may be spaced less than or equal to 1 mm apart in a lateral direction. The slats may be adjustable within the frame. The vent assembly may occupy from 0.1 to 50% of total surface area of the upper.

In still further aspects, the present invention is directed to a waterproof and breathable rubber boot comprising: an upper made of a natural or synthetic rubber having a water vapor permeability of less than 3 mg/cm$^2$/h according to ISO 14268 (2012) and comprising at least two vents, wherein at least one vent is disposed in a toe cap region of the upper and wherein at least one vent is disposed in an upper portion of the upper material relative to the toe cap; a vent assembly disposed within each of the at least two vents, wherein each vent assembly comprises: a waterproof, water vapor permeable functional layer comprising ePTFE, a plurality of slats disposed adjacent to the functional layer and spaced apart from each other and from the functional layer, and further wherein the at least one vent assembly disposed in the upper portion of the upper comprises a rinse port. The boot may have a moisture vapor permeability of at least 0.4 g/hr according to ASTM D8041 (2016). The material of the upper and the material of the slats may each independently comprise polyvinyl chloride, copolyesters, woven aramids, polyurethane, thermoplastic polyurethane, polyurethane coated textiles, polyurethane coated foam, foamed ethylene-vinyl acetate, patent leather, treated leather, synthetic rubber and/or natural rubber. In some aspects, the material of the upper is synthetic rubber, natural rubber, or combinations thereof. The functional layer may have a water vapor permeability number Ret of less than 150 $m^2 \times Pa \times W^{-1}$ according to ISO 11092 (1993). The functional layer may comprise at least one of expanded polytetrafluoroethylene, polyester, copolyether ester, polyether, polyimide, copolyether amides, and polyacrylate. At least one side of the functional layer may be laminated to a textile, an open cell foam, or a reticulated foam. The textile may be a knit, a woven, a non-woven, or a felt. The article may further comprise an internal insulating layer adjacent to the upper. In some aspects, the slats are parallel to each other. The slats may be attached to a frame. In some aspects, the slats are off-set. The vent assembly may further comprise an overmold. The vent assembly may be attached to the upper by molding, vulcanization, application of a thermoplastic gasket or tape, an adhesive or is sewn onto the upper. The vent may comprise at least two rows of slats. The slats may be spaced less than or equal to 1 mm apart in a lateral direction. The slats may be adjustable within the frame. The vent assembly may occupy from 0.1 to 50% of total surface area of the upper.

In another aspect, the present invention is directed to a waterproof footwear article comprising an upper made of a waterproof material having a water vapor permeability of less than 3 mg/cm$^2$/h according to ISO 14268 (2012) and comprising at least one vent; and a vent assembly disposed within the at least one vent, wherein the vent assembly further comprises: a waterproof functional layer comprising polyurethane, and a plurality of slats disposed adjacent to the functional layer and spaced apart from each other and from the functional layer. The material of the upper and the material of the slats may each independently comprise polyvinyl chloride, copolyesters, woven aramids, polyurethane, thermoplastic polyurethane, polyurethane coated textiles, polyurethane coated foam, foamed ethylene-vinyl acetate, patent leather, treated leather, synthetic rubber and/or natural rubber. In some aspects, the material of the upper is synthetic rubber, natural rubber, or combinations thereof. At least one side of the functional layer may be laminated to a textile, an open cell foam, or a reticulated foam. The textile may be a knit, a woven, a non-woven, or a felt. The article may further comprise an internal insulating layer adjacent to the upper. In some aspects, the slats are parallel to each other. The slats may be attached to a frame. In some aspects, the slats are off-set. The vent assembly may further comprise an overmold. The vent assembly may be attached to the upper by molding, vulcanization, application of a thermoplastic gasket or tape, an adhesive or is sewn onto the upper. The vent may comprise at least two rows of slats. The slats may be spaced less than or equal to 1 mm apart in a lateral direction. The slats may be adjustable within the frame. The vent assembly may occupy from 0.1 to 50% of total surface area of the upper.

BRIEF DESCRIPTION OF THE DRAWINGS

The present invention will be better understood in view of the appended non-limiting figures, in which.

DETAILED DESCRIPTION OF THE INVENTION

Figure 1:
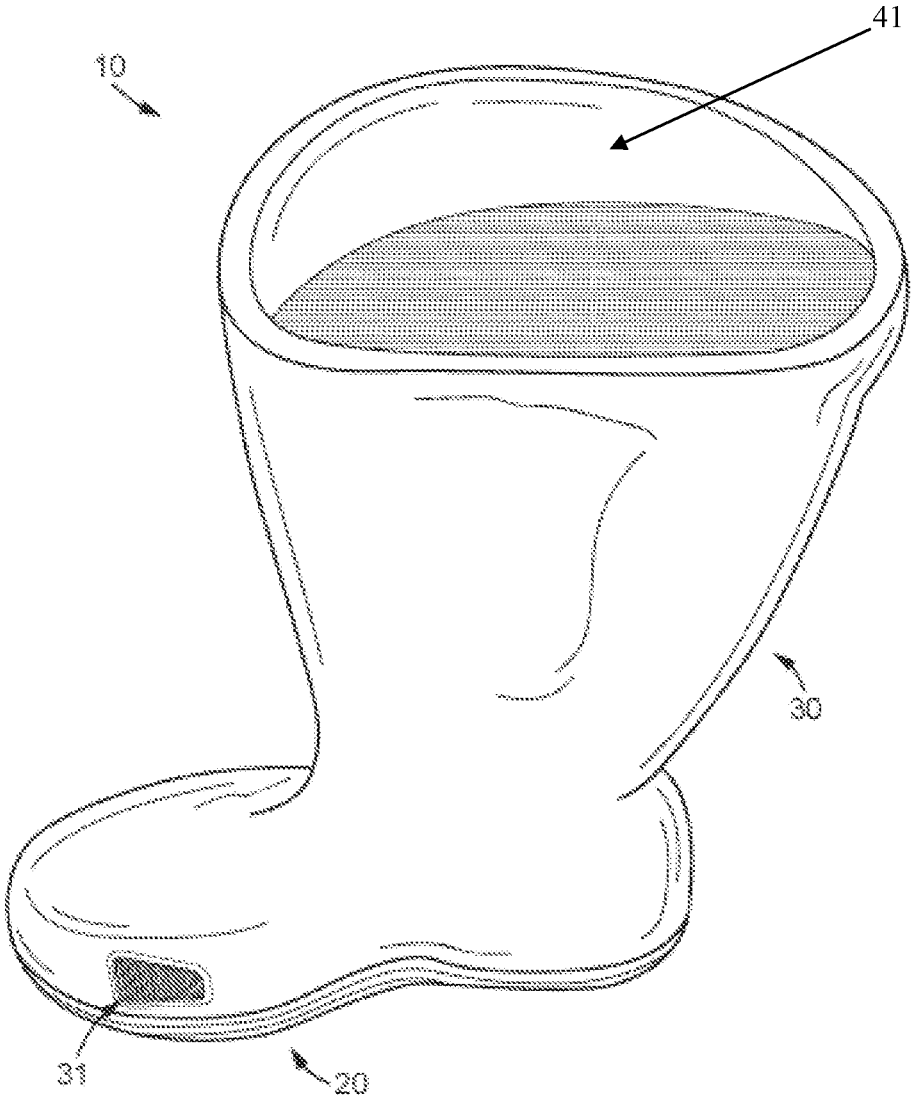
FIG. 1 is a perspective of a footwear article in accordance with embodiments of the present invention.

The present invention is directed to footwear articles which provide waterproofness and breathability. The invention incorporates a vent assembly into a vent in upper made of a waterproof material. The material of the upper has a breathability of less than 3 mg/cm$^2$/h according to ISO 14268 (2012), which for the purposes of this specification is regarded as non-breathable material. There are numerous benefits to using a non-breathable upper material, including ease of cleaning, durability, protection, and scent-control. Because of discomfort to the wearer due to non-breathability, however, the usefulness of the footwear article is decreased. Thus, there is a need to maintain an upper material with the desired benefits described above, but with improved comfort to the user. This may be achieved by including a vent assembly comprising a waterproof, water vapor permeable functional layer and a plurality of slats. The plurality of slats are disposed adjacent to, but not in physical contact with the functional layer. By incorporating slats into the vent assembly, a physical barrier is created to shield the functional layer from puncture or abrasion while allowing airflow to reach the functional layer. The space between the slats and the functional layer also allows for rinsing debris from the vent assembly. As compared to a standard grate, the slats reduce the likelihood of debris clogging the vent assembly and allow for rinsing debris from the vent assembly. The vent assembly also advantageously maintains the durability of the footwear article, but expands the performance by introducing breathability into the upper. The vent assembly allows for passive breathability to be introduced into the upper, e.g., no movement or use of the footwear article is required for the vent assembly to introduce breathability into the upper and into the footwear article as a whole.

Because of the incorporation of the vent assembly into the upper, the inventive footwear article has improved breathability while maintaining the durability and waterproofness provided by the non-breathable upper. In some aspects, the footwear article has a breathability of at least 0.4 grams per hour, according to ASTM D8041 (2016), e.g., at least 0.6 g/h or at least 0.8 g/h. In terms of ranges, the footwear article may have a breathability from 0.4 to 10 g/h, according to ASTM D8041 (2016), e.g., from 0.6 to 8 g/h or from 0.8 to 6 g/h. The footwear article may comprise one or more vent assemblies, as described herein, wherein the vent assembly comprises from 0.1 to 50% of the surface area of the upper, e.g., from 1 to 40% or from 3 to 35%. It should be understood when multiple vent assemblies are used, that the percentage refers to the total surface area. A minimum surface area is needed to provide breathability, and when the vent assembly is small and has a surface area of less than 0.1% of the surface of the upper, the breathability may not be significantly improved. In addition, to maintain the structural integrity of the footwear article, when the vent assembly is too large and has a surface area of greater than 50% of the upper, it may negatively affect the strength. In addition, the larger the surface of the vent assembly, the greater the exposure to puncture, thus requiring more sealing. Further increasing the surface area beyond 50% does not provide a diminishing return for improving breathability.

The footwear article may be a shoe or boot that is non-breathable due to the material used for at least the upper layer. For example, patent leather or otherwise treated leather shoes have reduced breathability. Additionally, outdoor boots, such as work boots, rubber boots, protective boots, field boots ("Wellington" style boots), ski boots, motorcycle boots, ice skates, and roller blades may contain upper materials having low breathability. The vent assembly design may primarily be chosen based on the end use of the footwear article. For example, a hunting or field boot may be subject to more abrasion or debris than a figure skate, and the vent assembly is designed accordingly. Such end uses and aesthetics influence the number of vent assemblies and the placement of vent assemblies, as well as the exposed surface area of the functional layer.

The footwear article may be manufactured and then modified to include the vent assembly, or the vent assembly may be integrated into the footwear article during manufacture of the upper, prior to attachment of the upper to the sole of the footwear article, or after the attachment but prior to further finishing steps.

The footwear article comprised of a sole and an upper. The upper comprises a vent and within the vent there is a vent assembly. Both the upper and the sole are waterproof and have low water-vapor permeability, e.g., are non-breathable. Water-vapor permeability is a measure of breathability, as described further herein and is used interchangeably with "breathability." Thus, for purposes of the present invention, an upper material having low water-vapor permeability is considered to be non-breathable. The sole, however, does not contain a vent assembly or other perforations and thus would also be considered non-breathable. Such vent assemblies or perforations in the sole are avoided for numerous reasons. First, because the sole of a footwear article is more structurally complex than the upper, it is more expensive and labor intensive to dispose a vent assembly in the sole. Second, because the sole is frequently in contact with the ground, the vent assembly may become clogged with debris unless a protective material is included. Third, again because the sole is frequently in contact with the group, the functional layer of the vent assembly may be punctured by debris unless a protective material is included. Finally, a vent assembly in the sole may interfere with the traction of the footwear article.

The amount of water-vapor allowed to escape the vent assembly, and ultimately the footwear article, is controlled by the moisture vapor transmission rate (MVTR) of the functional layer and the MVTR is also a measure of breathability and water-vapor permeability. As described herein, the functional layer is provided in the vent assembly is not a liner or bootie. Unlike other footwear articles which may include a laminate liner behind an upper material, the present footwear article comprises a vent assembly having a functional layer that is exposed to the environment for the purposes of water-vapor permeability. Due to the configuration of the slats, the functional layer may be at least partially covered by the slats, though the slats do not directly contact the functional layer. Specifically, the functional layer of the vent assembly is exposed to the environment, allowing for escaping moisture to avoid being trapped by the upper material. The inclusion of a plurality of slats between the functional layer and the environment allow for water-vapor to escape from within the footwear article by being spaced apart, and also serve the purpose of protecting the functional layer from puncture or abrasion. In some aspects, the functional layer may have improved protection by using off-set slats.

The upper material in the footwear article is chosen to serve several purposes: durability, protection, and ease of cleaning, among others, To achieve this purpose, however, the materials lack breathability, which decreases the wearer's comfort. In some aspects, the material of the non-breathable upper may be polyvinyl chloride, copolyesters, woven aramids, polyurethane, thermoplastic polyurethane, polyurethane coated textiles, polyurethane coated foam, foamed ethylene-vinyl acetate, patent leather, treated leather, synthetic rubber and/or natural rubber. In one embodiment, the non-breathable upper may be synthetic rubber and/or natural rubber. In addition, combinations of these materials may be used in the upper. Regardless of the type of material, the material of the upper is non-breathable, e.g., having a water-vapor permeability of less than 3 $mg/cm^2/h$ according to ISO 14268 (2012).

The footwear article comprises one or more waterproof vent assemblies, e.g., at least two vent assemblies, at least three vent assemblies, or at least four vent assemblies. The number of vent assemblies is not particularly limiting. The vent assembly may have a thickness that matches the thickness of the upper material and any optional liner layers or insulation in the upper material. A vent assembly having the same thickness of the upper (and any optional layers) may lead to improved comfort for the wearer because the vent assembly does not extend beyond the upper and rub on the wearer. Additionally, having the vent assembly not extend beyond the outer surface of the upper may be more aesthetically pleasing. In some aspects, however, the vent assembly may extend beyond the surface of the upper, e.g., from 0.1 to 50 mm. In these aspects, the vent assembly may have a tapered shape, so that the edges of the vent assembly are flush with the upper and the center of the vent assembly protrudes from the upper.

The vent assembly may have a thickness from 5 to 125 mm, depending on the end use of the upper. The size and shape of the vent assemblies may be selected based on the desired surface area of the vent assembly and the desired surface area of the functional layer that is exposed to water-vapor. The vent assembly may have a different surface area than the exposed functional layer because the functional layer may be bonded to a frame or overmold which reduces the exposed surface area of the functional layer. The frame may be formed from the same material as the slats, described herein, though it need not be. In some aspects, the frame may be made of the same material as the upper, and the slats may be made from a different material. The frame may be attached to the upper to form a watertight seal, e.g., to maintain a waterproof footwear article. In some aspects, the frame may comprise openings and holes. Such openings and holes may be included when the vent assembly is attached to the upper by injection molding (for an elastomeric rubber) since the openings and holes will allow the materials to flow through the openings and holes to form a mechanical bond. The molten injection material reflows the surface of the frame, thus forming a waterproof seal. In other aspects, such as when the vent assembly is attached to the upper by vulcanization, the frame need not include such openings or holes. The vent assembly may be attached according to other methods, such as application of a thermoplastic gasket or tape, an adhesive or is sewn onto the upper. Regardless of the method, the vent assembly must be attached to the upper in a manner that forms a waterproof seal between the upper and the vent assembly.

In some aspects, a frame is not included and the slat may be integrated directly into the upper material. The vent assembly is waterproof. The functional layer of the vent assembly is water-vapor permeable, which advantageously increases overall breathability of the footwear article and maintains the waterproofness.

When included, the overmold is placed between the slats and the functional layer. The overmold may be formed from the same or different material from the slats.

The slats may be made of the same material as the upper, allowing for easier manufacture of the footwear article. This may also make the vent assemblies appear aesthetically pleasing. As described herein, such materials may be polyvinyl chloride, copolyesters, woven aramids, polyurethane, thermoplastic polyurethane, polyurethane coated textiles, polyurethane coated foam, foamed ethylene-vinyl acetate, patent leather, treated leather, synthetic rubber and/or natural rubber. In addition, combinations of these materials may be used in the upper. Regardless of the type of material, the material in the upper is non-breathable, e.g., having a breathability of less than 3 $mg/cm^2/h$ according to ISO 14268 (2012). In other aspects, the slats are a different material than the upper. The slats may be a different material than the upper for numerous reasons, including desiring stronger material, stiffer material, or more flexible material. For example, the slats may be formed from thermoplastic polyurethanes having a 60D or 95 A hardness. The slats may have a thickness from 0.1 to 100 mm.

The spaced apart slats may be parallel to each other. In other aspects, the slats can be non-parallel, such as perpendicular or at any other angle. The slats need not all be the same size or shape. In some aspects, the vent assembly comprises at least 2 nested rows of slats, e.g., at least 3 nested rows of slats, at least 4 nested rows of slats, or more. The slats may be arranged in any desirable cross-sectional shape, including a square, rectangle, trapezoid, circle, oval, triangle, star, or other polygon. In still further aspects, the slats may be off-set, meaning in different planes and not directly on top of one another or overlapping. In a configuration where one row of slats is included, the slats may be at an angle to each other and are therefore nested. In a configuration having stacked rows, the slats are positioned so that the slats are at an angle to each other and so that the functional layer is exposed to the environment for purposes of water-vapor permeability but at least partially obstructed by the slats to protect the functional layer against debris and abrasion.

In some aspects, the vent assembly comprises two levels of off-set, non-intersecting rows of slats. Instead, the slats are arranged in a concentric shape. The vent assembly may also comprise a frame surrounding the slates in a circular shape, and also cutting across the radius of the shape in multiple locations. In such aspects, the frame may provide support to the vent assembly while also providing increased protection for the functional layer as compared to a vent assembly with only one row of slats, or with parallel slats.

In even further aspects, the slats may be adjustable. For example, the slats may be adjustable from an open to closed position, including partial positions. The adjustability would allow the wearer to close the vents when desired, such as for increased warmth in cold conditions, for increased scent-control in hunting applications, and for increased protection from impact in skiing applications. The slats may be adjusted by hand, or there may be a lever or other device that allows for the user to adjust the slats. The slats may also be rotatable within the vent assembly, allowing for the angle of the slats to be changed relative to the footwear article.

The slats may be spaced less than or equal to 1 mm apart, e.g., 0.8 mm or less, or 0.6 mm or less. The slats may be placed apart in a lateral direction. As used herein, "lateral direction" refers to the direction along the outer surface of the upper. Such spacing allows for water-vapor permeability while providing protection for the functional layer. The slats may be spaced at least 1 mm apart from the functional layer. In some aspects, when the slats are off-set, there from a top view, there is a spacing of at least 0.25 mm between the slats in the top plane and the slats in the lower plane.

The vent assembly may further comprise a rinse port between the slats and the functional layer. The rinse port allows for washing out or removing mud, ice, or other debris that may accumulate between the slats. The accumulation of such debris may clog or otherwise block the slats which in turn reduces the breathability of the vent assembly. The rinse port may be included in the frame and may have a larger surface area or a different shape than the openings between slats. In some aspects, the rinse port may run perpendicular to the direction of the slats. In other aspects, the rinse port may run parallel to the slats. The rinse port may be placed between the slats and the frame, or may be placed amid the slats. In some aspects, the vent assembly comprises more than one rinse port, e.g., two rinse ports.

Depending on the size and placement of the vent assembly in the footwear article, instead of including a rinse port, the inside edges of the frame may be chamfered, e.g., angled, to allow for debris to be easily rinsed out of the vent assembly.

The vent assembly further comprises a functional layer. The functional layer may be any type of layer that has a water vapor permeability number Ret of less than 150 $m^2$ Pa $W^{-1}$. Water vapor permeability is tested according to the Hohenstein skin model. This test method is described in DIN EN 31092 (February 1994) or ISO 11092 (1993). Additionally, the functional layer is waterproof. The functional layer is considered waterproof, if it guarantees a water entry pressure of at least $1\times10^4$ Pa. The functional layer material preferably guarantees a water entry pressure of more than $1.\times10^5$ Pa. The water entry pressure is to be measured according to a test method in which distilled water at 20+2° C. is applied to a sample of 100 $cm^2$ of the functional layer with increasing pressure. The pressure increase of the water is 60+3 cm $H_2O$ per minute. The water entry pressure then corresponds to the pressure at which water first appears on the other side of the sample. Details of the procedure are stipulated in ISO Standard 0811 from 1981.

The functional layer may comprise a membrane or other layer of material, or a laminate. In some aspects, the functional layer comprises at least one of expanded polytetrafluoroethylene, polyester, polyurethane, expanded polyethylene, copolyether ester, polyether, polyamide, copolyether amides, and polyacrylate. Other suitable thermoplastic and elastomeric films may be used as well. The functional layer material may be selected for compatibility with the vent assembly. For example, a thermoplastic polyurethane frame or overmold may be compatible and achieve good chemical and mechanical bonding with a polyurethane membrane.

In an aspect of the invention, the waterproof, water-vapor permeable membrane may be made of a fluoropolymer, particularly made of microporous expanded polyterafluorethylene (ePTFE). The microporous polytetrafluoroethylene membrane is expanded polytetrafluoroethylene as taught in U.S. Pat. Nos. 3,953,566 and 4,187,390, the entireties of which are incorporated by reference herein. Such membranes of expanded polytetrafluoroethylene are present in commercially available fabrics from W. L. Gore and Associates, under the tradename GORE-TEX® fabric. The water vapor permeable and waterproof membrane may be composed of a polyurethane coated microporous expanded polytetrafluoroethylene membrane made substantially according to the teachings of U.S. Pat. Nos. 4,194,041 and 4,942,214 assigned to W.L. Gore and Associates, Inc, in Elkton, Md., the entireties of which are incorporated by reference herein. In some aspects, the membrane may have a monolayer configuration, or may have a more complex configuration, e.g. a multi-layer configuration.

The functional layer may include supporting layers, backing layers, or cover layers laminated to the first and/or second sides of the membrane, respectively, or may include additional coatings or fillers, respectively. The supporting layer, backing layer and/or cover layer may be textile layers, described below. In particular embodiments of the laminate, the first and second membranes will be laminated to the intermediate textile layer directly, i.e. without interposing any additional layers. Then, the intermediate textile layer may perform the function of a reinforcing layer. Lamination as used herein generally refers to the superposition of two, or more, layers to each other, typically by use of a suitable adhesive or other bonding means.

In some aspects, at least one side of the functional layer is laminated to a textile, an open cell foam, or a reticulated foam. The textile may be a knit, a woven, a non-woven, or a felt. The term "woven" may include any textile structure made up with weft and warp yarns or filaments. The term "knit" is to be understood broadly, in particular including any forms of warp knits and circular knits, but also covering any other configurations where a textile structure is produced by wrapping one or more yarns or filaments such as to form loops. Thus, a knit as used herein may also cover configurations that might be referred to as braided structures. The textile layer may be made from natural or synthetic fibers, in particular from polyester, polyamide, or mixtures thereof. For example, a nylon warp knit or felt may be used. When one side of the functional layer is laminated to a textile or a foam, the textile or foam may be disposed on the inner surface of the boot, so that it contacts the wearer, thus preventing rubbing of the functional layer on the wearer. In some aspects, a thin layer of waterproof material may be mounted on an open cell foamed polyurethane structure. Both sides of the functional layer are laminated to a textile, so long as the vent assembly still meets a breathability of at least 0.4 g/h as described herein.

The footwear article may further comprise conventional footwear components, such as a liner and/or an internal insulating layer 41 adjacent to the upper, as depicted in FIG. 1. When such components are included, the vent assembly is also disposed through these materials, i.e., the liner will have a hole to allow the vent assembly to penetrate the entire wall of the footwear article. When an insulating layer 41 is included, breathability of the inventive footwear article may be decreased as compared to footwear articles not comprising such an internal insulating layer. For example, a footwear article with an insulating layer and comprising a vent assembly may have a breathability of at least 0.4 g/h, e.g., 0.6 g/h, 0.8 g/h or 1.0 g/h, while an uninsulated footwear article may be designed to have a breathability of at least 1.6 g/h, e.g., at least 1.8 g/h or at least 2.0 g/h. The footwear article may also have an antimicrobial treatment or other known means for scent control. Although such treatments may be used in the footwear article, they are not applied to the vent assembly.

In some aspects, the footwear article is a waterproof and breathable rubber boot comprising: an upper made of a natural or synthetic rubber having a water vapor permeability of less than 3 $mg/cm^2/h$ according to ISO 14268 (2012) and comprising at least two vents. At least one vent is disposed in a toe cap region of the upper and at least one vent is disposed in an upper portion of the upper material relative to the toe cap. The rubber boot comprises a vent assembly disposed within each of the at least two vents, wherein each vent assembly comprises a waterproof, water vapor permeable functional layer and a plurality of slats disposed adjacent to the functional layer and spaced apart from each other and from the functional layer to provide for water-vapor flow through the vent assembly. The at least one vent assembly disposed in the upper portion of the upper comprises a rinse port. The at least one vent assembly disposed in the toe cap portion of the upper material need not comprise a rinse port, and may instead comprise a frame having chamfered edges.

In some aspects, the footwear article is a waterproof footwear article comprising an upper made of a waterproof material having a water vapor permeability of less than 3 $mg/cm^2/h$ according to ISO 14268 (2012) and comprising at least one vent. The footwear article comprises a vent assembly disposed within the at least one vent, wherein the vent assembly further comprises a waterproof functional layer comprising polyurethane and a plurality of slats disposed adjacent to the functional layer and spaced apart from each other and from the functional layer. The breathability of the waterproof functional layer comprising polyurethane may vary, and may be non-breathable and present merely for aesthetic purposes.

As shown in FIG. 1, footwear article 10 is comprised of a sole 20 and an upper 30. Upper 30 comprises a vent and within the vent there is a vent assembly 31.

Figure 2:
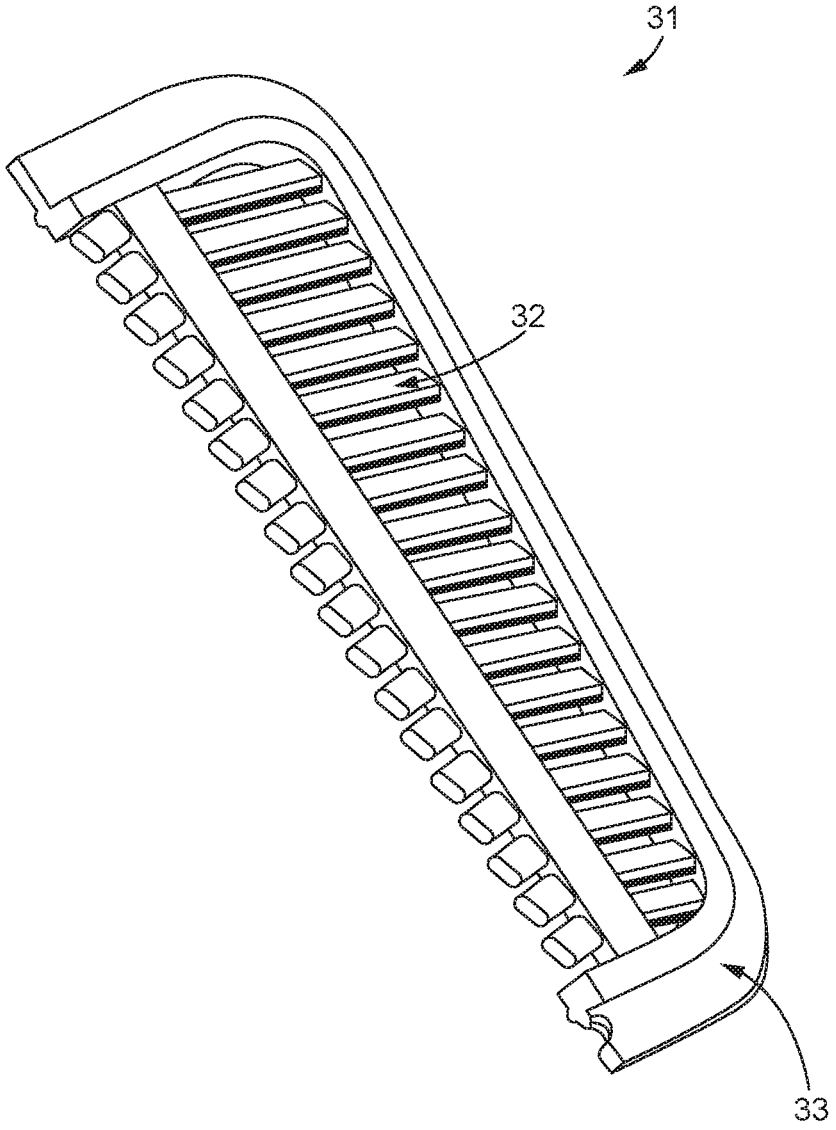
FIG. 2 is a perspective view of a vent frame and slats in accordance with embodiments of the present invention.

FIG. 2 shows vent assembly 31 which comprises slats 32 that are spaced apart and mounted to frame 33. The spaced apart slats may be parallel to each other. In other aspects (not shown), the slats can be non-parallel, such as perpendicular or at any other angle.

Figure 3:
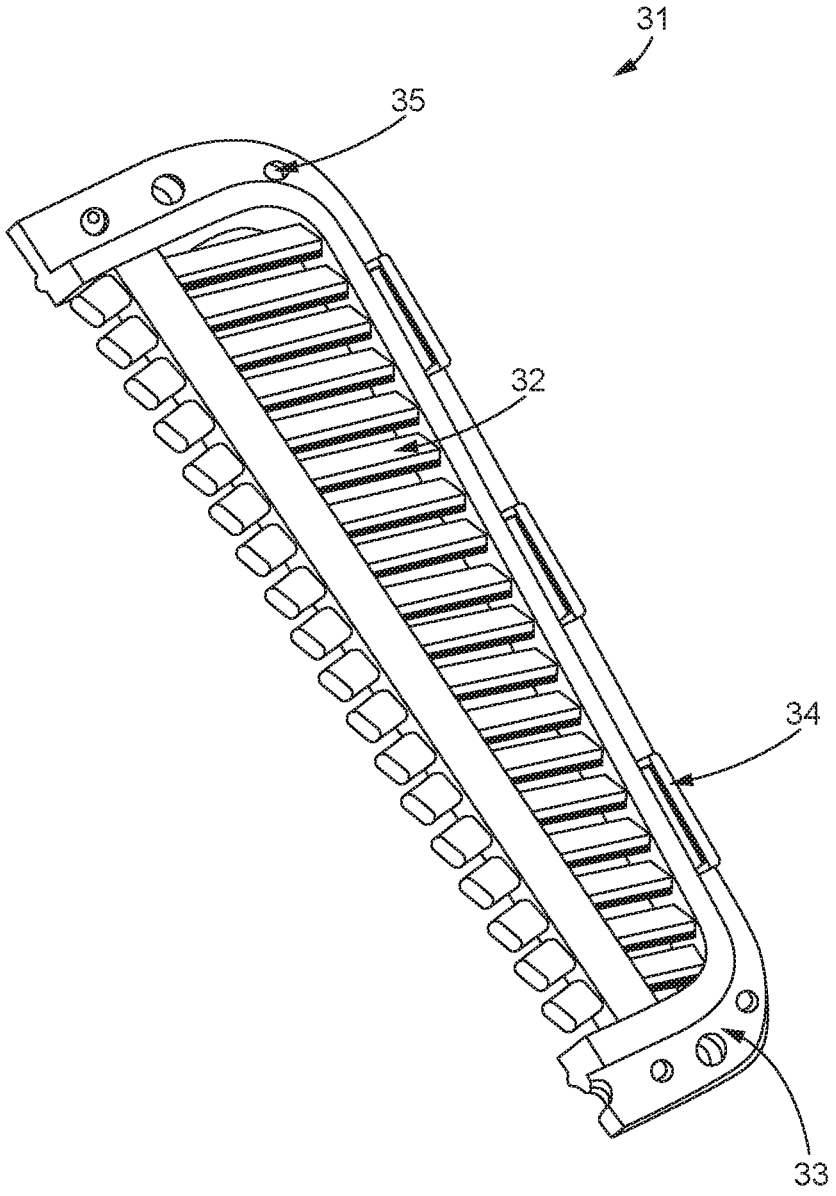
FIG. 3 is a perspective view of a vent frame and slats in accordance with embodiments of the present invention.

FIG. 3 shows a vent assembly as in FIG. 2, except that frame 33 comprises openings 34 and holes 35. As described herein, the openings and holes may be included in the frame when the vent assembly is secured to the upper by injection molding. The openings and holes will no longer be visible when the vent assembly is incorporated into the upper.

Figure 4:
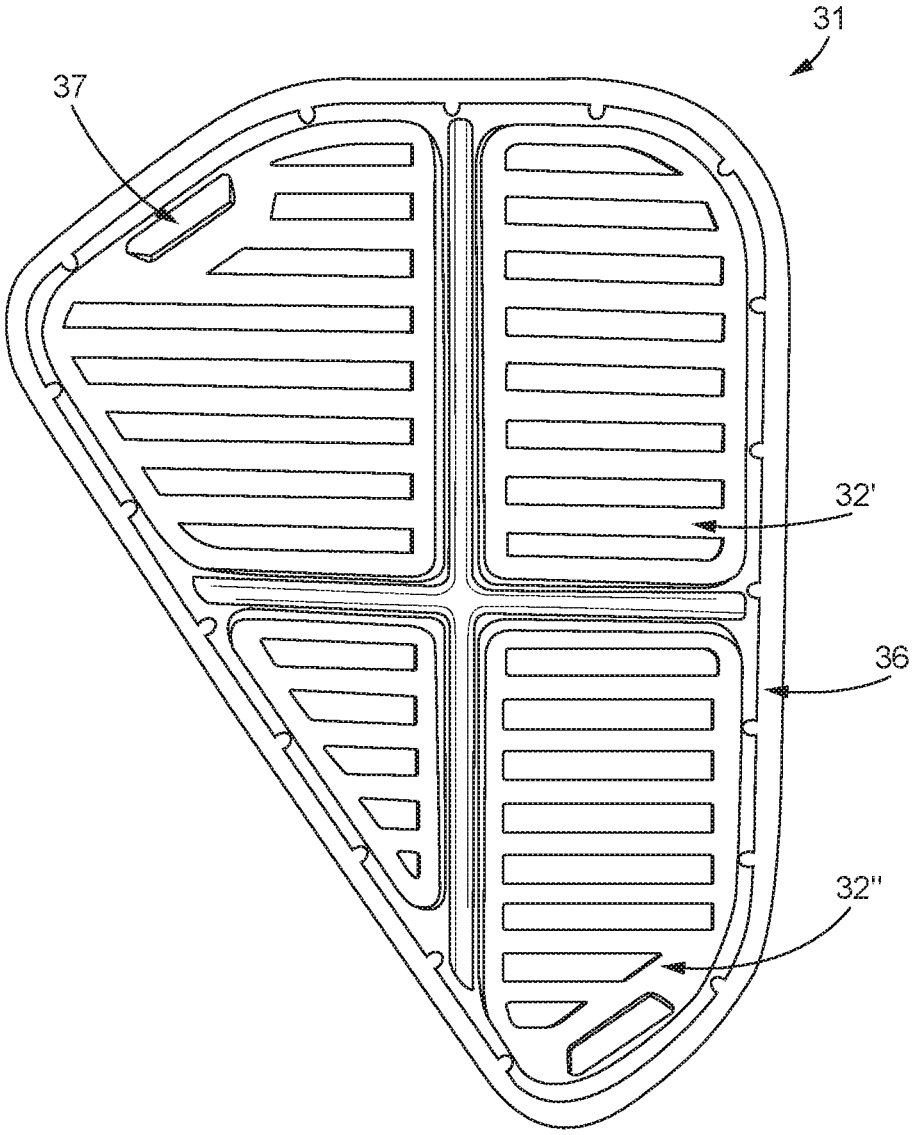
FIG. 4 is a perspective view of a vent assembly in accordance with embodiments of the present invention.

As shown in FIG. 4, the slats need not all be the same size. Slat 32' has a different size and shape than slat 32". Additionally, as shown in FIG. 4, vent assembly 31 may comprise an overmold 36. Overmold 36 is placed between the slats and the functional layer (not shown). Overmold 36 may be formed from the same or different material from the slats. The vent assembly may further comprise a rinse port 37 between the slats and the functional layer.

Figure 5:
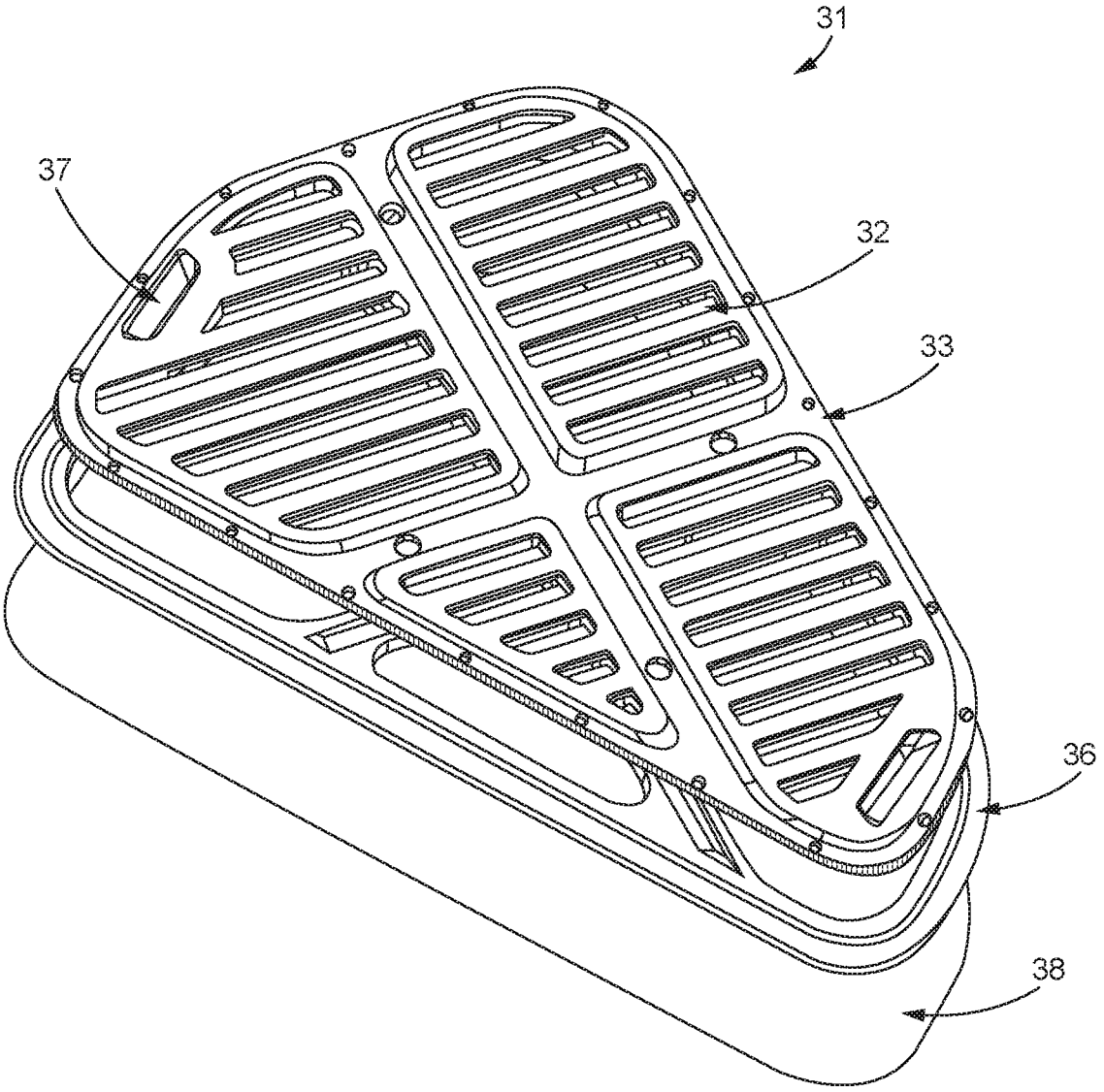
FIG. 5 is an exploded view of a vent assembly in accordance with embodiments of the present invention.

FIG. 5 provides an exploded view of vent assembly 31 of FIG. 4. Vent assembly 31 comprises slats 32, frame 33, overmold 36, rinse port 37, and functional layer 38.

Figure 6:
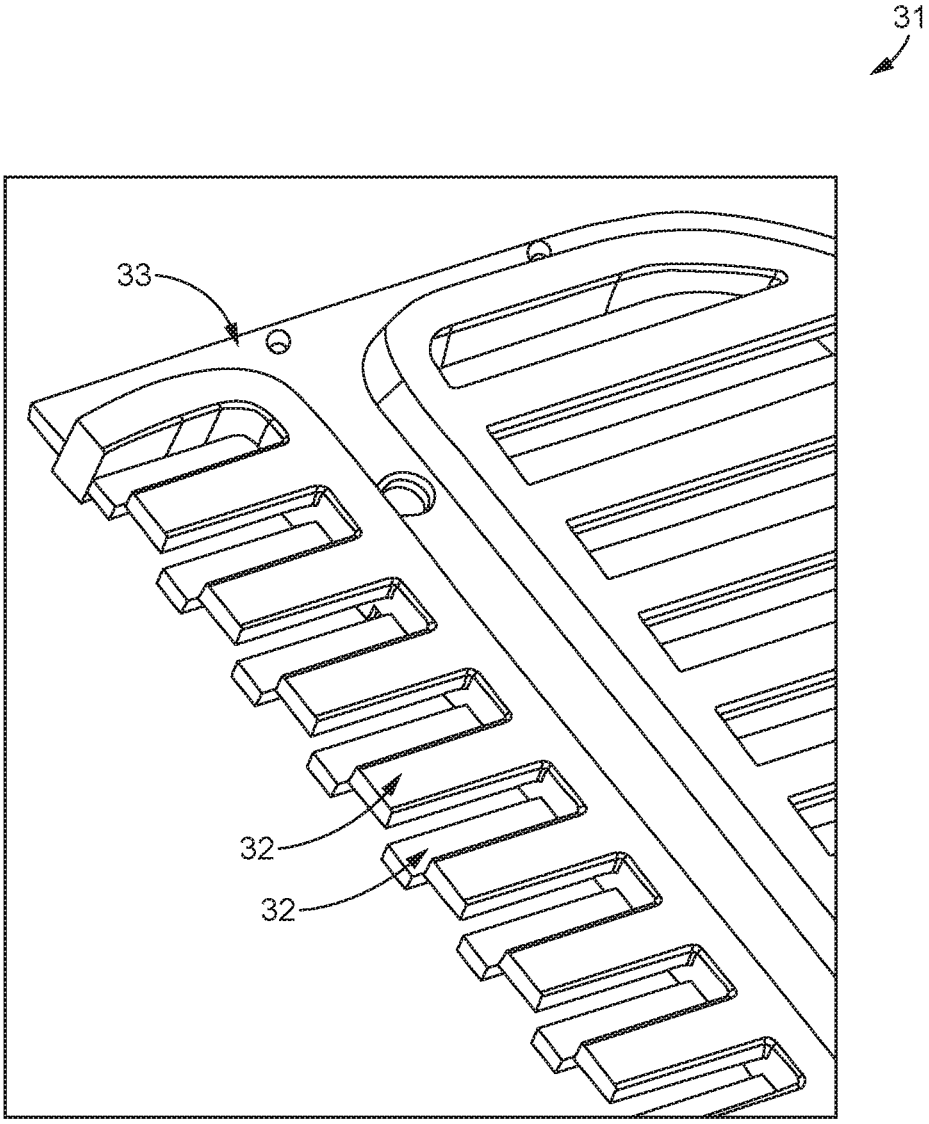
FIG. 6 is a perspective view of off-set slats in accordance with embodiments of the present invention.
Figure 7:
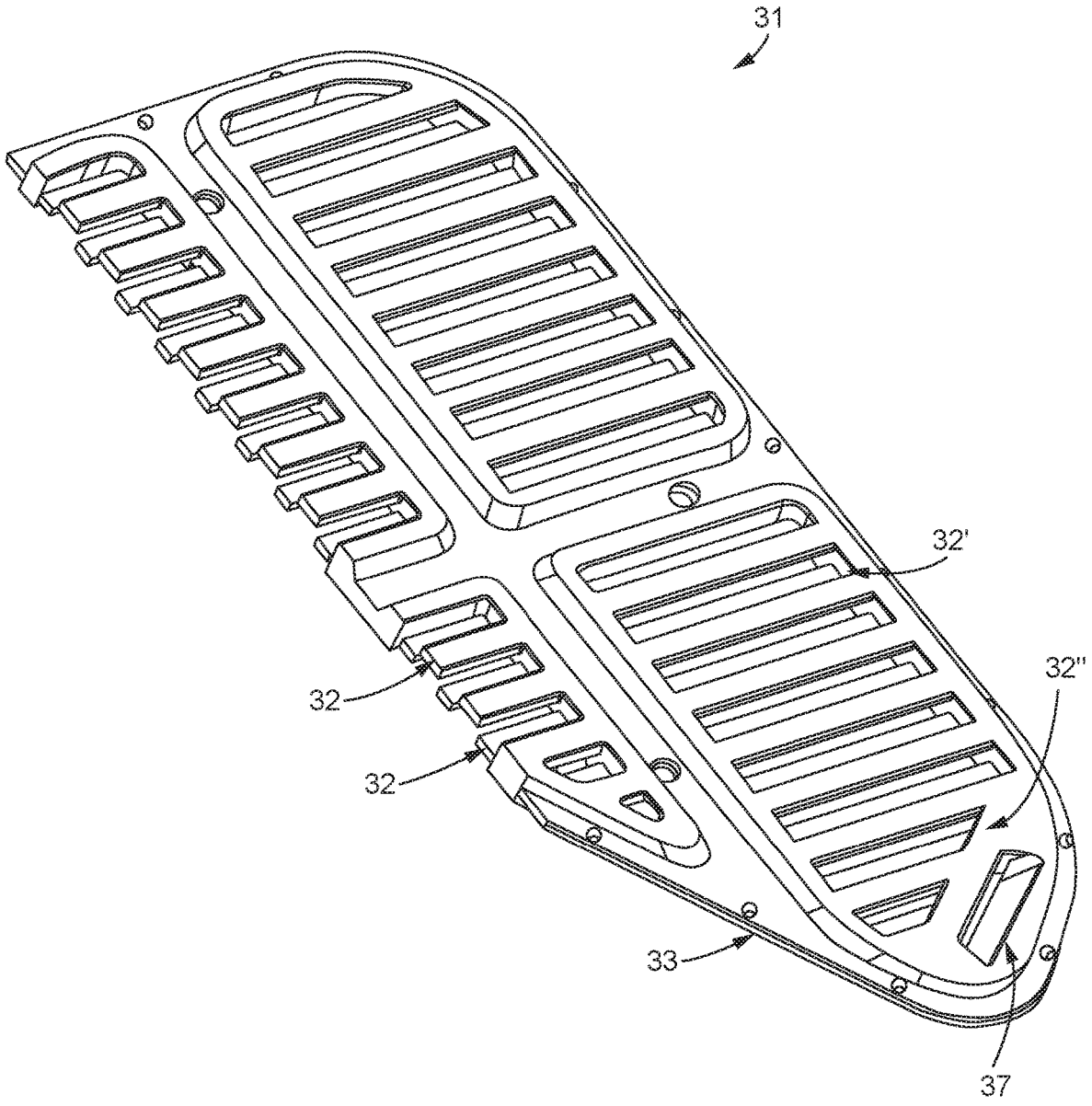
FIG. 7 is perspective view of additional off-set slats in accordance with embodiments of the present invention.

As shown in FIG. 6, the vent assembly comprise off-set slats which are slats in different planes that are not directly on top of one another or overlapping. ion. shown FIG. 7 shows an expanded view of FIG. 6, and shows that slats 32 are off-set and also have different shapes and lengths 32' and 32".

Figure 8:
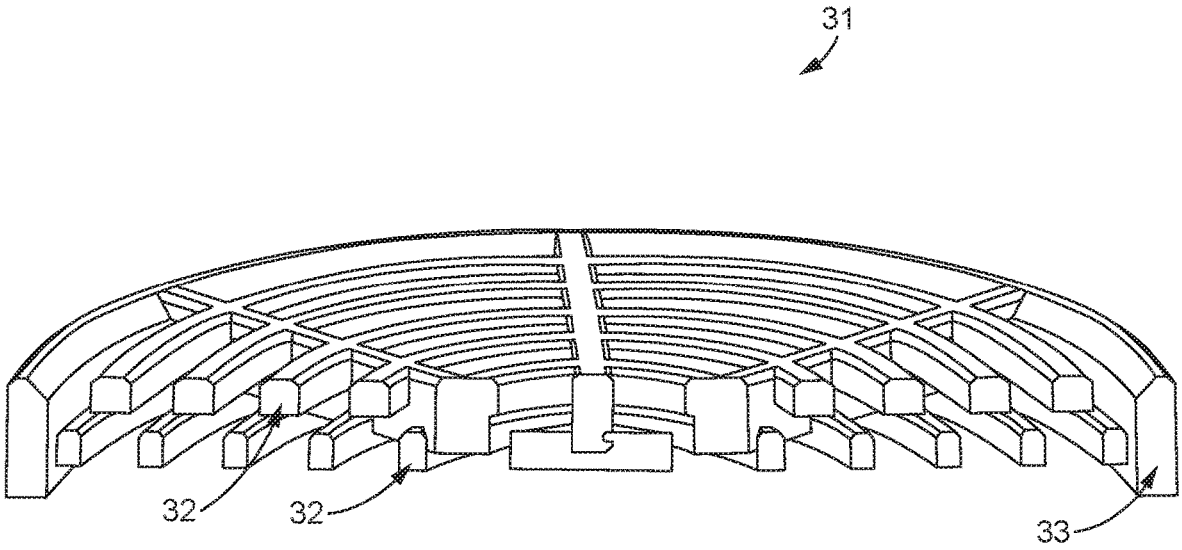
FIG. 8 is a perspective view of slats in accordance with embodiments of the present invention.
Figure 9:
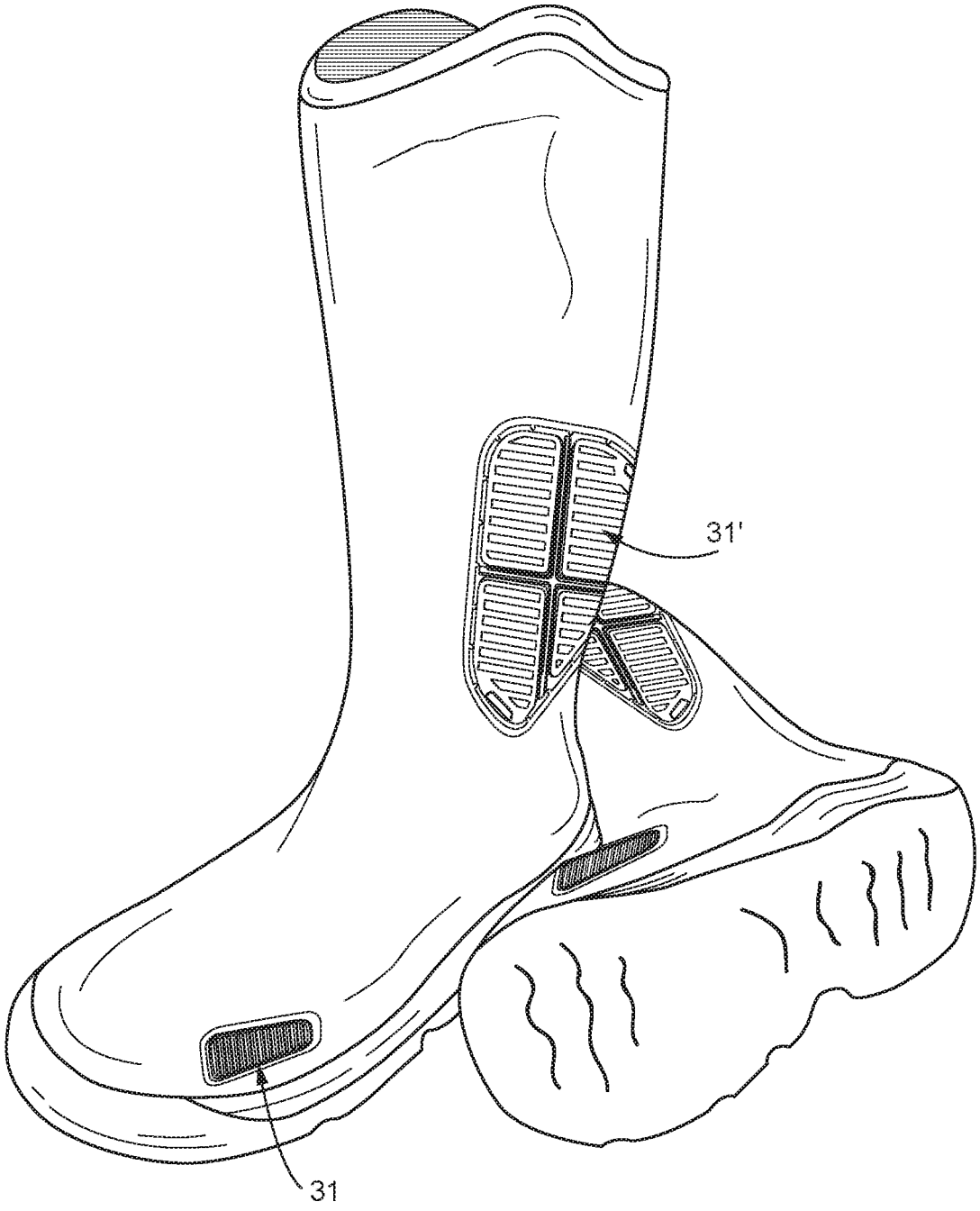
FIG. 9 is a perspective of a footwear article in accordance with embodiments of the present invention.

The vent assembly shown in FIG. 8 comprises two rows of off-set, non-intersecting rows of slats. Instead, slats 32 are arranged in a concentric shape. The vent assembly in FIG. 8 also shows frame 33 surrounding the slates in a circular shape, and also cutting across the radius of the shape in multiple locations. In such aspects, the frame may provide support to the vent assembly while also providing increased protection for the functional layer as compared to a vent assembly with only one row of slats, or with parallel slats.

FIG. 8 shows a footwear article 10 is comprised of a sole 20 and an upper 30. Upper 30 comprises a vent and within the vent there is a first vent assembly 31 and a second vent assembly 31'.

EXAMPLES

Whole Boot Moisture Vapor Transmission Rate Test

The Whole Boot Moisture Vapor Transmission Rate for each sample was determined in accordance with the Department of Defense Army Combat Boot Temperate Weather Specifications. The specifications are as follows:

Whole Boot Breathability

The boot breathability test shall be designed to indicate the Moisture Vapor Transmission Rate (MVTR) through the test sample by means of a difference in concentration of moisture vapor between the interior and the exterior environment.

Apparatus a. The external test environment control system shall be capable of maintaining 23 (±1) ° C. and 50%±2% relative humidity throughout the test duration.

b. The weight scale shall be capable of determining the weight of test samples filled with water to an accuracy of (±0.01) gram.

c. The water holding bag shall be flexible so that it can be inserted into the test sample and conform to the interior contours; it must be thin enough so that folds do not create air gaps; it must have much higher MVTR than the footwear product to be tested; and it must be waterproof so that only moisture vapor contacts the interior of the footwear product rather than liquid water.

d. The internal heater for the test sample shall be capable of controlling the temperature of the liquid water uniformly in the test sample to 35 (±1) ° C.

e. The sealing method around the collar of the test sample shall be impervious to both liquid water and water vapor.

Procedure a. Place sample in test environment and condition for at least 12 hours.

b. The heating device is inserted into the water holding bag and the complete assembly is then placed into the test sample opening and filled with water to a height of 5 cm measured from inside sole.

c. Seal opening around the collar with plastic wrap around the top of the footwear and tape over using packaging tape.

d. Heat water in test sample to 35° C.

e. Weigh test sample and record as Wi.

f. Hold temperature in test sample after weighing for a minimum of 4 hours.

g. After a minimum of 4 hours, reweigh test sample. Record weight as Wf and test duration as Td.

h. Calculate MVTR of the test sample in grams/hour from the equation below: MVTR=(Wi−Wf)/Td.

This test is in accordance with ASTM D8041 (2016).

Footwear Article Centrifuge Waterproofness Tests

Waterproofness for each footwear article was determined by use of the Centrifuge test described in U.S. Pat. No. 5,329,807, and incorporated by reference herein in its entirety. The centrifuge tests were carried out for 30 minutes. The footwear article was considered to be waterproof if no leakage was seen after 30 minutes.

Upper and Functional layer Waterproofness Test

An upper and a functional layer are considered to have waterproof characteristics in case the requirements specified in DIN EN 343 (2010) are met, i.e., a test of the liquid water resistance with respect to hydrostatic water pressure according to EN 20 811 (1992) yields a liquid water resistance $W_p$ of 8000 Pa, or more.

Testing of Upper Material Breathability

Four different upper materials were tested for water-vapor permeability in accordance with ISO 14268 (2012). The results of the test are shown in Table 1 below.

TABLE 1

| Upper Material Water-Vapor Permeability | | | | | |
|---|---|---|---|---|---|
| Upper | Thickness (mm) | Material | Substrate | Coating | Permeability ($mg/cm^2/h$) |
| a) | 0.7 | Full grain leather | Jersey Backer | polyurethane | 0.3 |
| b) | 0.5 | 1000 denier woven nylon | — | polyurethane | 0.6 |
| c) | 2.2 | Full grain leather | — | polyurethane | 0.7 |
| d) | 1.2 | Rubber | — | — | 0.0 |

As shown above, the water-vapor permeability of treated textiles and full grain leather materials was non-breathable, e.g., less than 3 $mg/cm^2/h$ when tested in accordance with ISO 14268 (2012).

Comparative Example A

Upper d) described above was formed into a rubber boot. The rubber boot also had a rubber sole. The rubber boot had a breathability of 0 g/h when tested in accordance with in accordance with ASTM D8041 (2016).

Example 1

An upper d) was modified to include a vent, into which a vent assembly comprising a functional layer and a row of slats was disposed. The vent assembly was sealed to the upper to form a waterproof seal. The vent assembly comprised a total breathable surface area of 29.4 square inches (about 189.7 square cm). The boot was tested for waterproofness as described herein and was found to be waterproof. The MVTR of the boot was tested as described herein in accordance with ASTM D8041 and had a breathability from 4.7 to 4.8 g/hr.

Because the rubber boot had an initial breathability (without a vent assembly) of 0 g/h, the breathability of the inventive rubber boot was equal to the breathability of the vent assembly.

Example 2

Five vent assemblies of identical materials and shape were prepared, with the only different being the surface area of the exposed functional layer. Each vent assembly was attached to a rubber upper in a waterproof manner, and the rubber upper was formed into a boot with a rubber sole as in Comparative Example A. The MVTR of each footwear article was then tested in accordance with ASTM D8041 and the surface area of the exposed functional layer was plotted versus the MVTR. The results are shown in FIG. 8. The first data point in FIG. 8, 0 g/h MVTR and 0 surface area, reflects the results reported in Comparative Example A, which had no vent assembly included.

Figure 10:
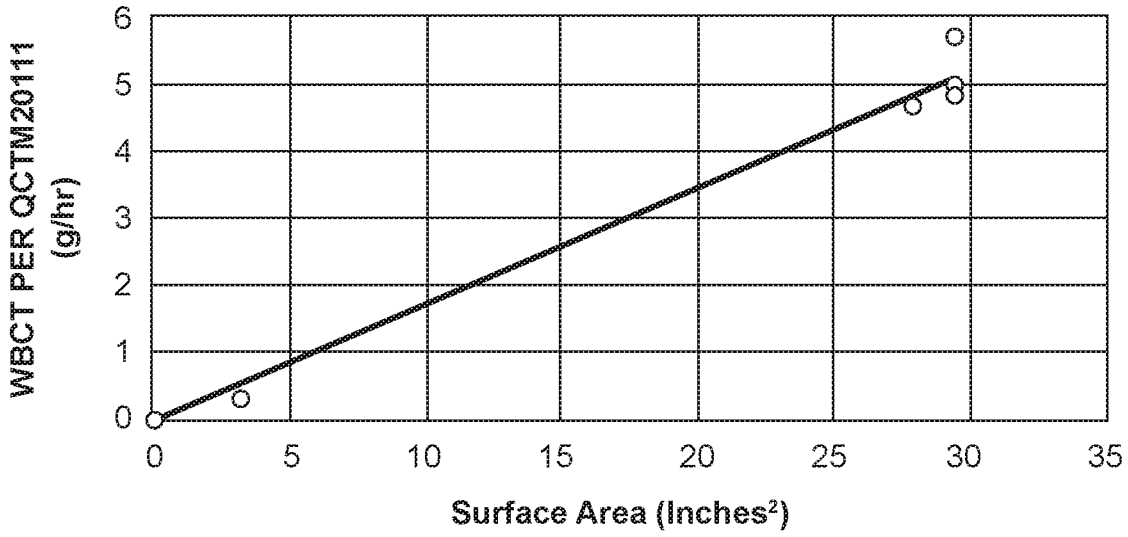
FIG. 10 is a graph of the breathability of a footwear article as a function of surface area of a vent assembly in accordance with embodiments of the present invention.

The results in FIG. 10 show that the relationship between MVTR and exposed surface area of the functional layer is linear: the greater the surface area, the greater the MVTR.

The invention of this application has been described above both generically and with regard to specific embodiments. Although the invention has been set forth in what is believed to include certain preferred embodiments, a variety of alternatives known to those of skill in the art can be selected to be within the generic disclosure. The invention is not otherwise limited, except for the recitation of the claims set forth below.

What is claimed is:

1. A waterproof and breathable footwear article comprising:

an upper made of a waterproof material having a water vapor permeability of less than 3 mg/cm2/h according to ISO 14268 (2012) and comprising at least one vent; and a vent assembly disposed within the at least one vent, wherein the vent assembly comprises:

a waterproof, water vapor permeable functional layer, and a plurality of slats disposed adjacent to the functional layer, wherein the plurality of slats are spaced apart from each other and from the functional layer.

2. The article of claim 1, wherein the article has a moisture vapor permeability of at least 0.4 g/hr according to ASTM D8041 (2016).

3. The article of claim 1, wherein the material of the upper and the material of the slats each independently comprise at least one of a polyvinyl chloride, a copolyester, a woven aramid, a polyurethane, a thermoplastic polyurethane, a polyurethane coated textile, a polyurethane coated foam, a foamed ethylene-vinyl acetate, a patent leather, a treated leather, a synthetic rubber or a natural rubber.

4. The article of claim 1, wherein the functional layer comprises at least one of an expanded polytetrafluoroethylene, a polyester, a copolyether ester, a polyether, a polyurethane, an expanded polyethylene, a polyamide, a copolyether amide, and a polyacrylate.

5. The article of claim 1, wherein at least one side of the functional layer is laminated to a textile, an open cell foam, or a reticulated foam.

6. The article of claim 1, wherein the article further comprises an internal insulating layer adjacent to the upper.

7. The article of claim 1, wherein the slats are off-set.

8. The article of claim 1, wherein the slats are attached to a frame.

9. The article of claim 1, wherein slats are nested.

10. The article of claim 1, wherein the vent assembly further comprises an overmold.

11. The article of claim 1, wherein the vent assembly is attached to the upper by molding, vulcanization, application of a thermoplastic gasket or tape, an adhesive, or is sewn onto the upper.

12. The article of claim 1, wherein the slats are spaced less than or equal to 1 mm apart in a lateral direction.

13. The article of claim 1, wherein the vent assembly comprises a rinse port.

14. The article of claim 1, wherein the at least one vent assembly occupies from 0.1 to 50% of a total surface area of the upper.

15. A waterproof and breathable rubber boot comprising:

an upper made of at least one of a natural or a synthetic rubber, having a water vapor permeability of less than 3 mg/cm 2/h according to ISO 14268 (2012) and comprising at least two vents, wherein at least one vent is disposed in a toe cap region, and wherein at least one vent is disposed in an upper portion of the upper material relative to the toe cap; and a vent assembly disposed within each of the at least two vents, wherein each vent assembly comprises:

a waterproof water vapor permeable functional layer comprising expanded polytetrafluoroethylene, and a plurality of slats disposed adjacent to the functional layer, wherein the plurality of slats are spaced apart from each other and from the functional layer, and wherein the at least one vent assembly disposed in the upper portion of the upper comprises a rinse port.

16. A waterproof footwear article comprising:

an upper made of a waterproof material having a water vapor permeability of less than 3 mg/cm 2/h according to ISO 14268 (2012), wherein the upper comprises at least one vent; and a vent assembly disposed within the at least one vent, wherein the vent assembly comprises:

a waterproof, water vapor permeable functional layer comprising polyurethane, and a plurality of slats disposed adjacent to the functional layer, wherein the plurality of slats is spaced apart from each other and from the functional layer.

* * * * *